US009990899B2

(12) United States Patent
Hara et al.

(10) Patent No.: US 9,990,899 B2
(45) Date of Patent: Jun. 5, 2018

(54) IMAGE DISPLAY APPARATUS COMBINING THREE-IN-ONE WITH SINGLE COLOR LIGHT-EMITTING ELEMENTS

(71) Applicant: Mitsubishi Electric Corporation, Chiyoda-ku, Tokyo (JP)

(72) Inventors: Zenichiro Hara, Tokyo (JP); Shoji Otsuka, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 47 days.

(21) Appl. No.: 14/910,900

(22) PCT Filed: Nov. 18, 2013

(86) PCT No.: PCT/JP2013/081032
§ 371 (c)(1),
(2) Date: Feb. 8, 2016

(87) PCT Pub. No.: WO2015/033485
PCT Pub. Date: Mar. 12, 2015

(65) Prior Publication Data

US 2016/0196796 A1 Jul. 7, 2016

(30) Foreign Application Priority Data

Sep. 6, 2013 (JP) ..... 2013-184651

(51) Int. Cl.
*G09G 3/32* (2016.01)
*G09G 3/20* (2006.01)
(Continued)

(52) U.S. Cl.
CPC ..... *G09G 5/003* (2013.01); *G09G 3/32* (2013.01); *G09G 5/02* (2013.01); *G09G 5/10* (2013.01);
(Continued)

(58) Field of Classification Search
CPC .. G09G 3/2074; G09G 3/2077; G09G 3/2003; G09G 3/32; G09G 3/3208;
(Continued)

(56) References Cited

U.S. PATENT DOCUMENTS 6,443,597 B1 9/2002 Natori
2004/0036668 A1 2/2004 Nakanishi
(Continued)

FOREIGN PATENT DOCUMENTS

CN 201259772 Y 6/2009
JP 10-254386 A 9/1998
(Continued)

OTHER PUBLICATIONS

International Search Report (PCT/ISA/210) dated Feb. 10, 2014, by the Japanese Patent Office as the International Searching Authority for International Application No. PCT/JP2013/081032.
(Continued)

*Primary Examiner* — Darlene M Ritchie
(74) *Attorney, Agent, or Firm* — Buchanan Ingersoll & Rooney PC

(57) ABSTRACT

An image display apparatus comprising a display section provided by pixels arranged in a grid pattern, each of the pixels being formed of a light-emitting element, in which basic grids are repeatedly arranged in a grid pattern, each of the basic grids consisting of four pixels of a 2 by 2 matrix, each of the basic grids having a pattern in which one or two pixels of the four pixels being assigned a three-in-one element including three primary colors of R, G, and B and the remaining pixels being assigned a single-color light-emitting element, and the apparatus comprises processor for correcting a first color reproduction range provided by chromaticities of the three primary colors of R, G, and B to a second color reproduction range by light-emission inten-
(Continued)

sity of the single-color light-emitting element and shifting chromaticity points for the three colors.

7 Claims, 13 Drawing Sheets

(51) Int. Cl.
*G09G 5/00* (2006.01)
*G09G 5/02* (2006.01)
*G09G 5/10* (2006.01)

(52) U.S. Cl.
CPC ... *G09G 3/2003* (2013.01); *G09G 2300/0452* (2013.01); *G09G 2320/0271* (2013.01); *G09G 2320/0626* (2013.01); *G09G 2320/0666* (2013.01); *G09G 2340/06* (2013.01)

(58) Field of Classification Search
CPC ..... G09G 3/3225; G09G 2320/0666; G09G 2320/0626; G09G 2320/0646; G09G 2340/06; G09G 2300/0452; G09G 5/026; G09G 3/2007; G09G 2320/0271; G09G 5/003; G09G 5/02; G09G 5/10
See application file for complete search history.

(56) References Cited

U.S. PATENT DOCUMENTS

2008/0018798 A1* 1/2008 Park ..... G09G 3/2003 348/655
2008/0084524 A1 4/2008 Inuzuka et al.
2009/0213036 A1 8/2009 Hara
2009/0315921 A1 12/2009 Sakaigawa et al.
2010/0253711 A1* 10/2010 Muroi ..... G02F 1/133603 345/690
2010/0289727 A1 11/2010 Miller et al.
2010/0315449 A1* 12/2010 Chaji ..... G09G 3/3208 345/690
2011/0006973 A1 1/2011 Lin
2011/0050695 A1 3/2011 Sullivan et al.
2011/0285762 A1 11/2011 Asano et al.
2012/0212515 A1* 8/2012 Hamer ..... G09G 3/2003 345/690
2012/0249404 A1 10/2012 Sakaigawa et al.
2013/0093783 A1 4/2013 Sullivan et al.
2013/0314435 A1 11/2013 Sullivan et al.
2013/0342589 A1* 12/2013 Jung ..... G09G 3/32 345/690
2014/0035465 A1* 2/2014 Raj ..... H05B 33/0869 315/151
2014/0078729 A1 3/2014 Hara
2014/0176617 A1* 6/2014 Jeong ..... G09G 3/2003 345/690
2014/0253545 A1 9/2014 Sullivan et al.
2015/0022567 A1 1/2015 Sullivan et al.

FOREIGN PATENT DOCUMENTS

JP 2001-75508 A 3/2001
JP 2003-255862 A 9/2003
JP 2004-140800 A 5/2004
JP 2008-96548 A 4/2008
JP 2008-131349 A 6/2008
JP 2009-230096 A 10/2009
JP 2011-242605 A 12/2011
JP 2012-108518 A 6/2012
JP 2012-173466 A 9/2012
JP 2012173466 A * 9/2012
JP 2012-527011 A 11/2012
JP 2013-504080 A 2/2013

OTHER PUBLICATIONS

Office Action (Communication pursuant to Rules 164(1) EPC/The partial supplementary European search report) dated Mar. 10, 2017, by the European Patent Office in corresponding European Patent Application No. 13893085.4. (8 pages).
Office Action issued in corresponding Chinese Patent Application No. 201380079428.3 dated Mar. 31, 2017 with English Translation.
The extended European Search Report dated Jul. 3, 2017, by the European Patent Office in corresponding European Application No. 13893085.4. (13 pages).
Office Action dated Oct. 4, 2016, by the Japanese Patent Office in corresponding Japanese Patent Application No. 2015-535283 and English translation of the Office Action. (7 pages).
Chinese Office Action dated Nov. 28, 2017, in corresponding Chinese Patent Application No. 201380079428.3, with English Translation (9 pages).

* cited by examiner

ONLY G IS LIT IN
THREE-IN-ONE ELEMENT

ONLY G IS LIT IN
THREE-IN-ONE ELEMENT

IMAGE DISPLAY APPARATUS COMBINING THREE-IN-ONE WITH SINGLE COLOR LIGHT-EMITTING ELEMENTS

TECHNICAL FIELD

The present invention relates to an image display apparatus in which a light-emitting element such as a light-emitting diode (LED) is used for a pixel.

BACKGROUND ART

A typical image display apparatus includes a display section formed of a number of display units arranged vertically and horizontally, and each of the display units is provided by arranging, in a grid pattern, pixels each formed of a light-emitting element such as an LED. To increase the resolution of the image display apparatus, it is necessary to reduce the pitch of the arranged pixels to arrange the pixels at a higher density. A large image display apparatus with a high resolution tends to have a higher cost due to the use of an increased number of LED elements per unit area.

An example of the large image display apparatus displays full-color images by having a display section formed such that pixels at least including an LED element for R (red), an LED element for G (green), and an LED element for B (blue) are arranged in a grid pattern on a basic grid (square grid) consisting of four pixels of a 2 by 2 matrix. For example, in the four pixels of the basic grid (square grid) consisting of the 2 by 2 matrix, an LED element for each of R, G, and B is assigned to three pixels, and G or R is assigned to the remaining one pixel.

The LED element allows arbitrary design of arrangement of three primary colors or arrangement pitch, which contributes to a recent selection of image display apparatuses with various resolution and luminance levels appropriate for different applications.

In another display type used in recent years, a three-in-one LED element (three-in-one element) including LED chips for three colors of R, G, and B put in a single LED lamp is used, and such three-in-one elements are arranged in a grid pattern.

When LED elements of the three-in-one type are arranged as pixels, one pixel emits light of three primary colors and thus the three colors are easily mixed as compared with a type in which single-color LED elements for R, G, and B are arranged. This provides a characteristic in which a viewer recognizes a mixed color at a shorter distance.

Various types of LED arrangement include the following ones including the LED element of the three-in-one type.

In recent years, applications requiring viewing at a shorter distance or applications requiring display with a higher resolution have increasingly employed a three-in-one element in which an LED pellet for three colors R, G, and B constitutes a single pixel (see, for example, Patent Document 1).

When the three-in-one element is used, an application requiring display of high-resolution contents with high image quality, for example Hi-Vision, involves a higher density of arrangement of LED elements, so that the cost is drastically increased and consumed power tends to be increased.

A proposed approach to reducing the cost is to reduce the number of LED elements while a reduction in image quality is minimized (see, for example, Patent Document 2).

Another proposed approach is to replace some of three-in-one LED elements with inexpensive white-color LED elements in a display having an array of three-in-one LED elements (see, for example, Patent Document 3).

As another example of the use of the white-color LED element, a recently proposed approach in the field of liquid crystal displays is to use four sub-pixels for colors of R, G, B, and W for a representative LED pixel arrangement of liquid crystal consisting of three colors of R, G, and B (see, for example, Patent Document 4).

CITATION LIST

Patent Literatures

PTL 1: JP-A-2001-75508
PTL 2: JP-A-2009-230096
PTL 3: JP-A-2012-173466
PTL 4: JP-A-2011-242605

SUMMARY OF INVENTION

Technical Problems

The approach of replacing some of the three-in-one elements with inexpensive white-color LED elements in the display including the array of three-in-one elements, however, has a problem in which the addition of the other color (white) to the three primary colors changes the proportion of the colors of R, G, and B and changes the hue of an image accordingly.

The present invention has been made in view of the above problem, and it is an object thereof to provide an image display apparatus capable of display with high image quality with a limited cost increase. Particularly, in a display having three-in-one elements including three primary colors of R, G, and B arranged in a grid pattern, some of pixels are replaced with single-color light-emitting elements to cut the cost and to reduce a hue change due to the influence of a single-color element.

Solution to Problem

An image display apparatus according to the present invention includes a display section provided by pixels arranged in a grid pattern, each of the pixels being formed of a light-emitting element, in which basic grids (square grids) are repeatedly arranged in a grid pattern, each of the basic grids consisting of four pixels of a 2 by 2 matrix, each of the basic grids having a pattern in which one or two pixels of the four pixels being assigned a three-in-one element including three primary colors of R, G, and B and the remaining pixels being assigned a single-color light-emitting element, and the apparatus comprises color reproduction range correcting means for correcting a first color reproduction range provided by chromaticities of the three primary colors of R, G, and B to a second color reproduction range through adjustment of light-emission intensity of the single-color light-emitting element.

Advantageous Effects of Invention

In the image display apparatus according to the present invention, some of the pixels can be replaced with the single-color light-emitting elements to cut the cost, and the light-emission intensity of the single-color light-emitting element can be adjusted to reduce a hue change due to the influence of the single-color light-emitting element.

Other objects, characteristics, aspects, and advantages of the present invention will be apparent from the following detailed description of the present invention with reference to the accompanying drawings.

DESCRIPTION OF EMBODIMENTS

First Embodiment

Figure 1A:
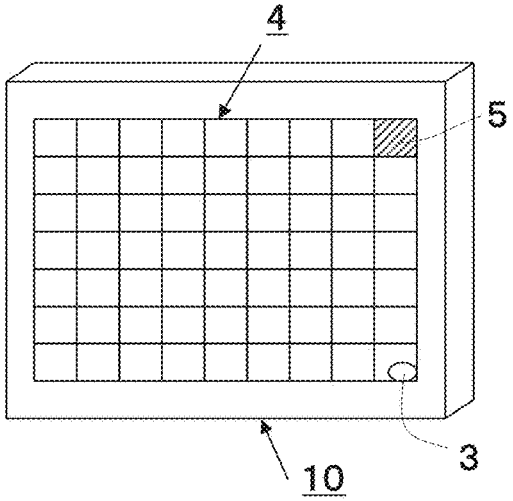
FIGS. 1A and 1B are diagrams showing the configuration of an image display apparatus necessary for describing the present invention.
Figure 1B:
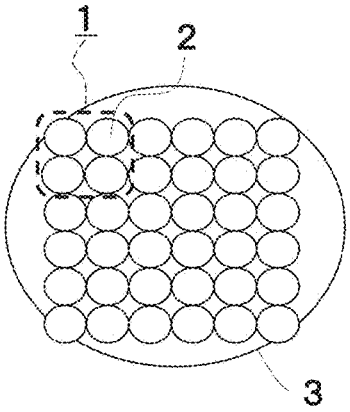

First, the basic configuration of an image display apparatus is described. FIG. 1A is a diagram showing the configuration of the image display apparatus necessary for describing the present invention. An image display apparatus 10 is, for example, a large display apparatus such as Aurora Vision®, and includes a display section (screen) 4 formed of a number of display units 5 arranged vertically and horizontally. FIG. 1B is an enlarged view of some pixels 3 in each display unit 5. The display unit 5 is formed such that pixels 2 each consisting of a light-emitting element such as an LED are arranged in a grid pattern, and for example, four pixels 2 of a 2 by 2 matrix constitute a single basic grid (square grid) 1. The display units 5 are arranged in a grid pattern to constitute the display section 4. For convenience, the pixels 2 constituting the basic grid 1 are in contact with adjacent pixels 2 in this example, but they are generally spaced from each other.

Figure 2A:
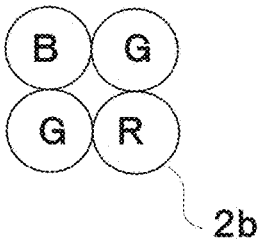
FIGS. 2A, 2B, and 2C are diagrams showing exemplary pixel arrangements necessary for describing the present invention.
Figure 2B:
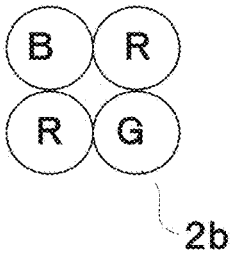
Figure 2C:
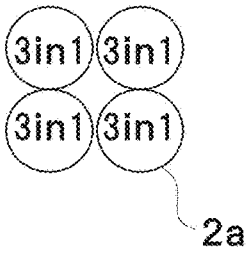

Next, a typical pixel arrangement in the image display apparatus 10 is described with reference to FIG. 2. FIGS. 2A, 2B, and 2C show exemplary pixel arrangements in one basic grid 1. For example, when three single-color light-emitting elements (single-color LED elements 2*b*) for three primary colors of R, G, and B are regularly arranged on pixels 2 as shown in FIGS. 2A and 2B, single-color LED elements 2*b* for R, G, and B are assigned to three of the four pixels 2 of the 2 by 2 matrix in the basic grid (square grid), and G or R is assigned to the remaining one pixel. Alternatively, as shown in FIG. 2C, a three-in-one LED element (hereinafter referred to simply as a three-in-one element) is assigned to all the pixels 2 in a grid pattern.

Figure 3:
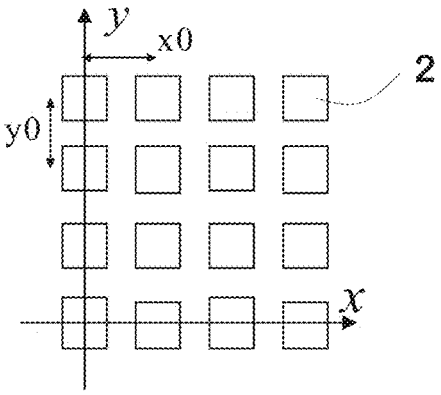
FIG. 3 is a diagram showing an arrangement of pixels to which coordinates are added necessary for describing the present invention.
Figure 4:
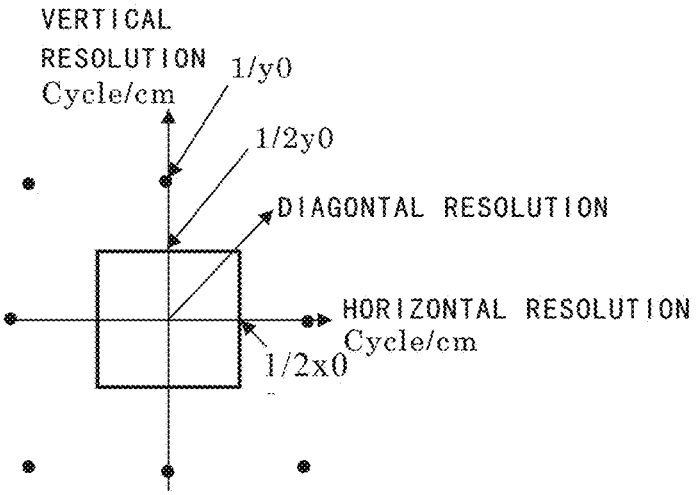
FIG. 4 is a diagram showing the spatial frequency characteristic of an image in the image display apparatus including a basic grid in FIG. 3.

FIG. 3 is a diagram showing a typical arrangement of pixels 2 to which coordinates are added for describing the operation of the present invention. Each box represents one pixel 2 in FIG. 3. FIG. 4 shows spatial frequency resolutions of an image in which horizontal and vertical resolutions of an image signal in FIG. 3 are shown two-dimensionally (the horizontal axis represents the horizontal resolution (Cycle/cm) and the vertical axis represents the vertical resolution (Cycle/cm)). As shown in FIG. 4, assuming that pitches of arranged pixels in a horizontal direction x and a vertical direction y are represented by x0 and y0, respectively, and that the sampling frequency of the image signal in the horizontal direction corresponds to the pixel pitch x0 (y0 for the vertical direction), the highest frequency of a restorable image signal is represented by 1/2x0, and the highest frequency of a restorable image signal in the vertical direction is represented by 1/2y0. In FIG. 4, the spatial frequency characteristic of a representable image is shown by a square area surrounded by a straight line including a point at 1/2x0 from the center on the horizontal axis and a point at 1/2y0 from the center on the vertical axis.

Figure 5:
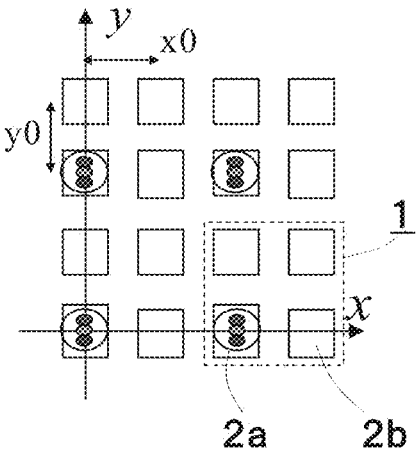
FIG. 5 is a diagram for describing an arrangement of pixels in the basic grid of the image display apparatus according to First Embodiment of the present invention.
Figure 6:
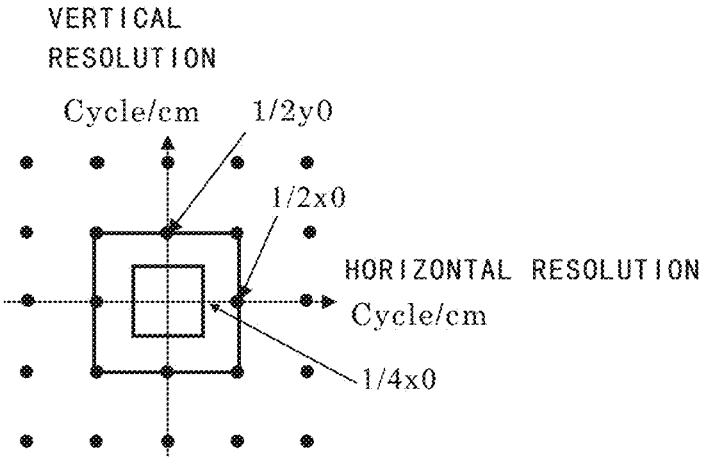
FIG. 6 is a diagram showing the spatial frequency characteristic of an image in the image display apparatus including the basic grid in FIG. 5.
Figure 7:
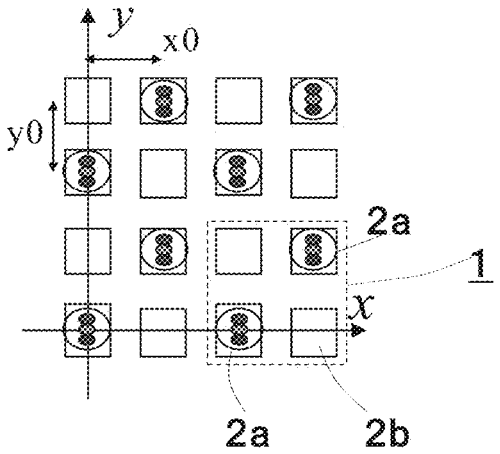
FIG. 7 is a diagram for describing another arrangement of pixels in the basic grid of the image display apparatus according to First Embodiment of the present invention.

FIG. 5 and FIG. 7 show exemplary pixel arrangements of the basic grid 1 in the image display apparatus 10 according to the present invention. FIG. 5 shows an exemplary pixel arrangement in which one three-in-one element 2*a* and three single-color LED elements 2*b* are placed in the 2-by-2 pixel basic grid 1. FIG. 7 shows an exemplary pixel arrangement in which two three-in-one elements 2*a* and two single-color LED elements 2*b* are alternately placed in the basic grid 1. As shown in those exemplary pixel arrangements, in the image display apparatus 10 according to First Embodiment of the present invention, some of the three-in-one elements 2*a* of the pixels 2 arranged in the grid pattern are replaced with inexpensive white-color LED elements 2*b*. The spatial frequency characteristic of a representable image is shown by a double structure as shown in FIG. 6.

In FIG. 6, the spatial frequency characteristic of a representable image in the three-in-one element 2*a* of the pixels 2 is represented by a square area surrounded by straight lines including a point at 1/4x0 from the center on the horizontal axis and a point at 1/4y0 from the center on the vertical axis. On the other hand, the spatial frequency characteristic of a representable image through control of both the white-color single-color LED element 2*b* and the three-in-one element 2*a* of the pixels 2 is represented by a square area surrounded by a straight line including a point at 1/2x0 from the center on the horizontal axis and a point at 1/2y0 from the center on the vertical axis, similarly to the example in FIG. 4. In other words, the spatial frequency characteristic of a displayable image in the pixel arrangement including one three-in-one element 2*a* in the basic grid 1 as shown in FIG. 5 is shown by the double structure consisting of an inner area represented by the square including the points at 1/4x0 and 1/4y0 in FIG. 6 and achieving full-color display with the arrangement of the pixel of the three-in-one element 2*a* and an outer area represented by the square including the points at 1/2x0 and 1/2y0 and achieving display through the control of both the three-in-one element 2*a* and the white-color single-color LED element 2*b*. The outer area does not necessarily have sufficient color information for full-color representation, but at least displays information about brightness/darkness.

Since human vision is less sensitive to color changes than to brightness/darkness characteristics, the region of higher resolutions is served by the white-color single-color LED element 2*b* which is the monochrome light-emitting element, and the region of lower resolutions is served by the three-in-one element 2*a* capable of color display, thereby achieving the effective representation capability suitable for the visual properties of humans.

In this case, the three-in-one element 2*a* including the three primary colors of R, G, and B is assigned to some pixels 2 of the four display pixels of the basic grid 1, and the single-color light-emitting element 2*b*, for example the white-color single-color LED element 2*b*, is assigned to the remaining pixels. When the screen is viewed at an extremely short distance, a distinct noise in a grid pattern due to the pixel structure may be found since the white-color LED lamp and three-in-one element 2*a* are mixed in the basic grid 1, but such a noise is not perceived when the screen is viewed at a proper distance at which the discrete pixels appear to be continuous.

As a result, the inexpensive white-color single-color LED elements 2*b* can be arranged at a high density to form the display section 4 with a high resolution. Specifically, the resolution of display is ensured through the use of the inexpensive white-color single-color LED element 2*b*, and the colors necessary for full-color display are provided by the three-in-one element 2*a*, thereby making it possible to achieve the full-color image display apparatus 10 at a low cost and a high resolution.

The exemplary pixel arrangement in FIG. 7 shows the case in which the three-in-one element 2*a* including the three primary colors of R, G, and B is assigned to two pixels 2 located diagonally, and the white-color single-color LED element 2*b*, for example, is assigned to the remaining two pixels 2 in the basic grid 1 consisting of four pixels of a 2 by 2 matrix. In FIG. 7, the pitches of the arranged pixels in the horizontal direction x and the vertical direction y are set to x0 and y0, respectively.

Figure 8:
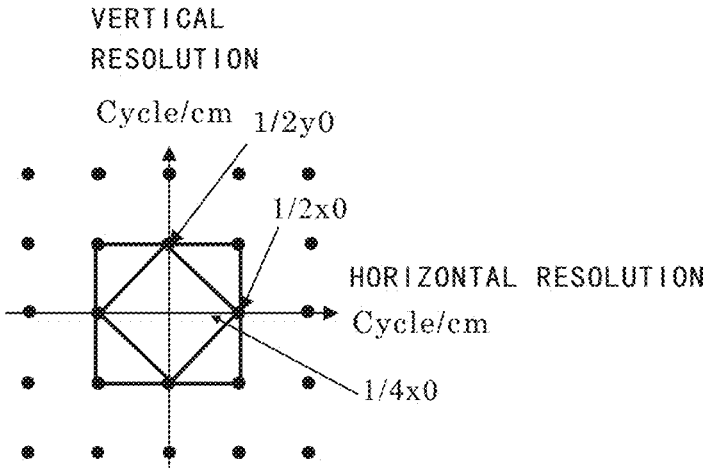
FIG. 8 is a diagram showing the spatial frequency characteristic of an image in the image display apparatus including the basic grid in FIG. 7.

FIG. 8 shows the spatial frequency characteristic representing the resolution of an image in the grid pixel arrangement in FIG. 7. In FIG. 8, assuming that the horizontal axis represents the horizontal resolution (Cycle/cm) and the vertical axis represents the vertical resolution (Cycle/cm), the spatial frequency characteristic of a representable image when the white-color single-color LED element 2*b* is used for the pixel 2 is represented by a square area surrounded by a straight line including a point at 1/2x0 from the center on the horizontal axis and a point at 1/2y0 from the center on the vertical axis, similarly to the case in FIG. 6. The spatial frequency characteristic of a representable image in the three-in-one element 2*a* is represented by a square area having apexes corresponding to a point at 1/2x0 from the center on the horizontal axis and a point at 1/2y0 from the center on the vertical axis.

In FIG. 8, as compared with FIG. 6, the area displayable through control of both the three-in-one element 2*a* and the white-color single-color LED element 2*b* surrounded by the line including the points at 1/2x0 on the horizontal axis and at 1/2y0 on the vertical axis is identical to that in FIG. 6. In contrast, the central area representable in full color with the arrangement of the three-in-one element 2*a* has twice the area of that in FIG. 6 since the number of the three-in-one elements 2*a* is increased to be twice as compared with the characteristic in FIG. 6. In addition, the three-in-one elements 2*a* are arranged alternately in a staggered form, so that the resulting shape provides horizontal and vertical resolutions with a higher priority than a diagonal resolution. Since a typical image includes more horizontal and vertical components than a diagonal component, the spatial frequency characteristic in FIG. 8 matches the typical image characteristics as well as the human visual properties. Thus, as compared with an arrangement in which the three-in-one element 2*a* is assigned to all the pixels 2 as shown in FIG. 2C, the pixel arrangement in FIG. 7 allows a significant cost reduction with a limited reduction in image quality since some of the three-in-one elements 2*a* are replaced with the inexpensive single-color LED elements 2*b*.

When the arrangement as shown in FIG. 5 and FIG. 7 is utilized in which some pixels of the basic grid 1 are replaced with the single-color pixels while the use of the three-in-one element 2*a* is maintained, the use of the three-in-one element 2*a* enables the full-color display, and simultaneously, the advantage of cost reduction can be achieved. In addition, the noise in the grid pattern due to the pixel structure can also be reduced on condition that the screen is viewed at a proper distance. For the hue, however, the color balance is adjusted on the basis of the three primary colors in the three-in-one element 2*a*, so that the addition of the other color to the three primary colors changes the hue of an image according to the change in the proportion of the colors of R, G, and B.

In view of the context described above, in First Embodiment of the present invention, description is made of the image display apparatus 10 capable of reducing the cost by replacing some of the pixels 2 with the single-color light-emitting elements and of reducing the hue change due to the influence of the single-color light-emitting element in the display 4 (which may be a screen or a display) having the three-in-one elements 2*a* including the three primary colors of R, G, and B arranged in the grid pattern.

Figure 9:
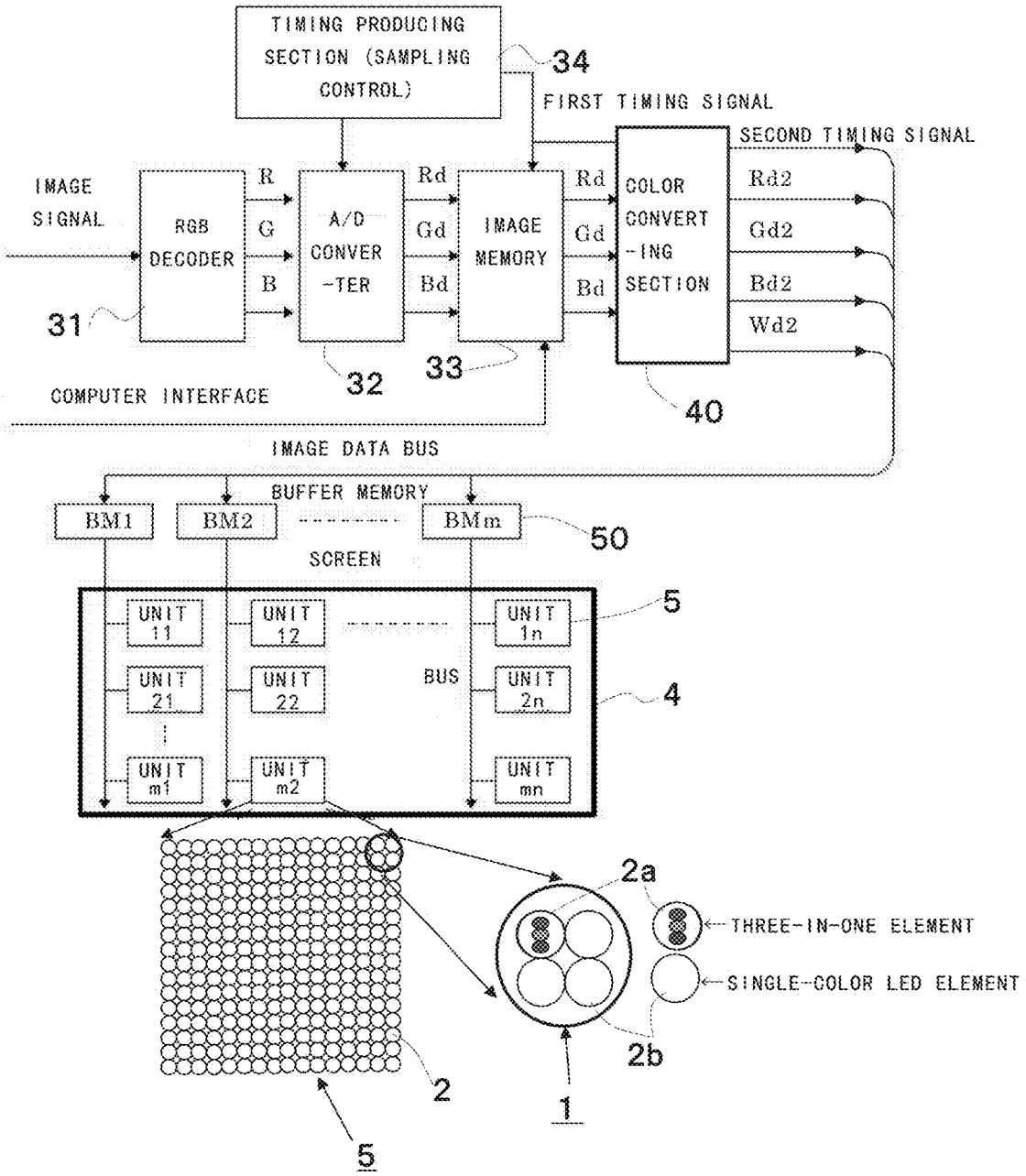
FIG. 9 is a diagram showing the configuration of the image display apparatus according to First Embodiment of the present invention.

FIG. 9 is a diagram showing the configuration of the image display apparatus 10 and illustrates the image display apparatus 10 including color reproduction range correcting means (color converting section 40) for adjusting the light-emission intensity (or luminance) of the white-color light-emitting element to correct a first color reproduction range formed of chromaticity of the three primary colors of R, G, and B in the present invention to a second color reproduction range.

As shown in FIG. 9, an image signal is input to an RGB decoder 31. The RGB decoder 31 decodes and separates the input image signal into three primary colors of R, G, and B to output signals for the respective colors of R, G, and B. The R, G, and B signals in analog form output from the RGB decoder 31 are input to an A/D converter 32 for analog/digital conversion followed by output as Rd, Gd, and Bd signals in digital form. The Rd, Gd, and Bd signals output from the A/D converter 32 are input to an image memory 33. The image memory 33 also receives the input of signals such as text or computer graphics from a computer interface and a first timing signal from a timing producing section (sampling control) 34. In a recent digital TV, image information is stored into the image memory 33 via a demultiplexing section for extracting video from packetized signals or an MPEG decoding section for decoding encoded images, rather than the RGB decoder 31 and the A/D converter 32, but common processing is performed after the image memory 33. The image memory 33 outputs the Rd, Gd, and Bd signals to a color converting section (color reproduction range correcting means) 40 in accordance with the timing signal. The color converting section 40 performs computation of the input signals with a predetermined color conversion function or the like and outputs Rd2, Gd2, and Bd2 signals after the color conversion processing together with a second timing signal. The output signals are input to display units (unit 11 to unit mn) 5 of the display section 44 via an image data bus and buffer memories (BM1 to BMm) and are used to adjust the light-emission intensity of the three-in-one element 2*a* or the white-color single-color LED element 2*b*constituting each pixel 2.

The color reproduction range correcting means corresponding to the color converting section 40 converts a wide color reproduction range into a practical color reproduction range by using the fact that the LED provides a higher color purity for a single color of R, G, or B than that of the three-in-one element 2*a* and a wider color reproduction range than that in the specifications for image signals of high image quality such as for Hi-Vision (HDTV). In the present invention, some of the three-in-one elements 2*a* are replaced with the inexpensive single-color LED elements and the inexpensive single-color LED element 2*b* is used, so that the present invention can compensate for reduced luminance in single-color display and a hue change caused since the proportion of the three primary colors is changed from that when only the three-in-one elements are used, thereby realizing the display apparatus at a low cost and with high image quality.

Figure 10:
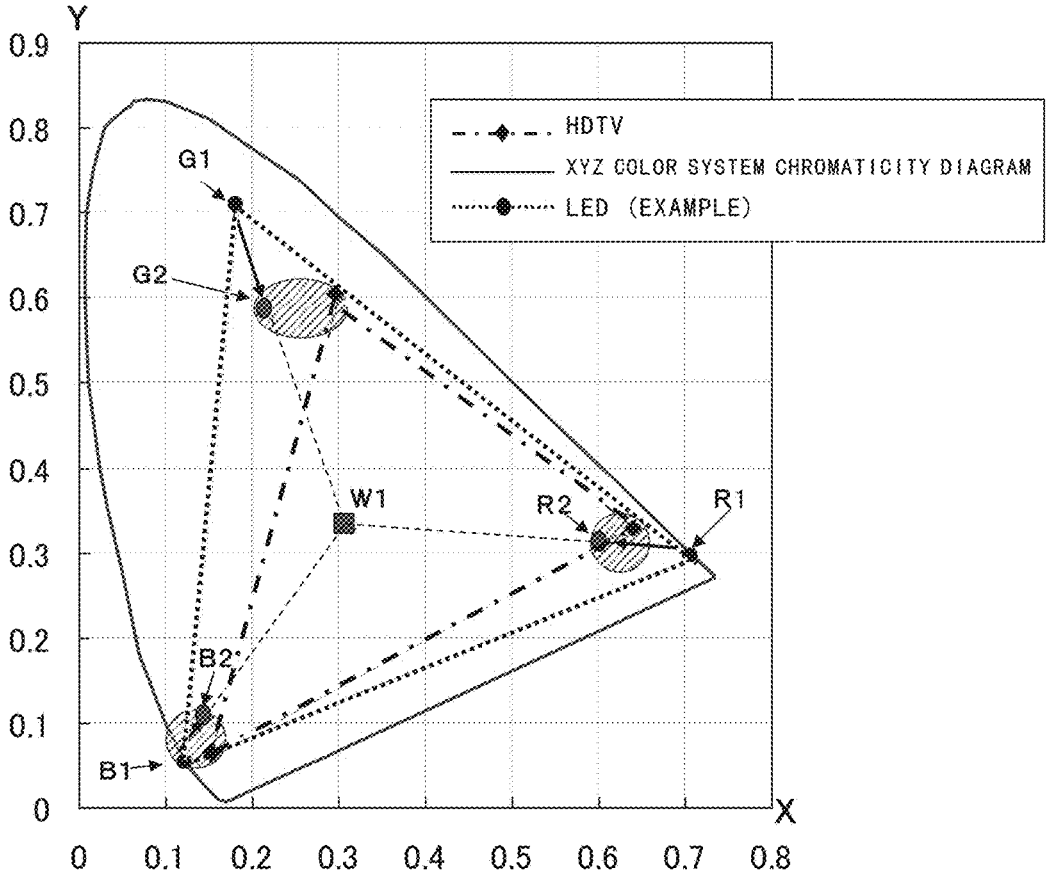
FIG. 10 is a diagram for describing a color reproduction range in First Embodiment of the present invention.

FIG. 10 is a diagram for describing the color reproduction range of the image display apparatus 10 according to First Embodiment and is a chromaticity diagram showing representative chromaticities of three primary colors in the LED (thick broken line, black circles) and chromaticities in the Hi-Vision specifications (HDTV) (dash-dotted line, black rhombus). A triangular area surrounded by the thick broken line connecting the chromaticity points of R, G, and B (R1, G1, and B1 (black circles)) corresponds to the color reproduction range of the LED (first color reproduction range). R2, G2, and B2 represent the chromaticity points of the respective colors after the color conversion. A triangular area surrounded by the chromaticity points of R2, G2, and B2 (the triangular shape is shown in FIG. 11 as later described) corresponds to the second color reproduction range in the present invention.

Figure 11:
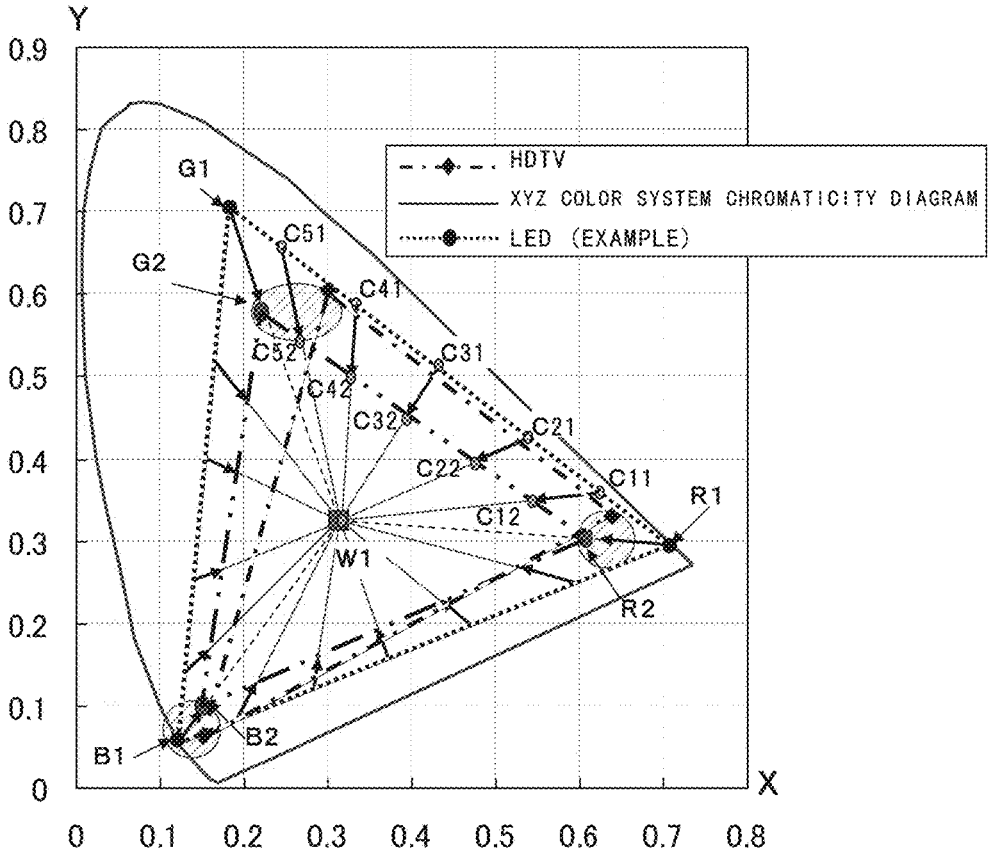
FIG. 11 is a diagram showing conversion of the color reproduction range in First Embodiment of the present invention.

FIG. 11 is a diagram showing the conversion of the color reproduction range, in which the second color reproduction range obtained by the conversion of the color reproduction range is represented as a triangular range surrounded by a chain double-dashed line with R2, G2, and B2 located at apexes.

As shown in FIG. 11, the color converting section 40 performs control such that, for the single color R, R1 is converted into R2 by lighting of W, and similarly, colors (R1, C11, C21, . . . C51, G1) located on a line R1-G1 are converted into colors (R2, C12, C22, . . . C52, G2) located on a line R2-G2. More particularly, the color converting section 40 performs control such that the color located on a C11-W1 line is converted into a color located on a C12-W1 line, for example.

Figure 12:
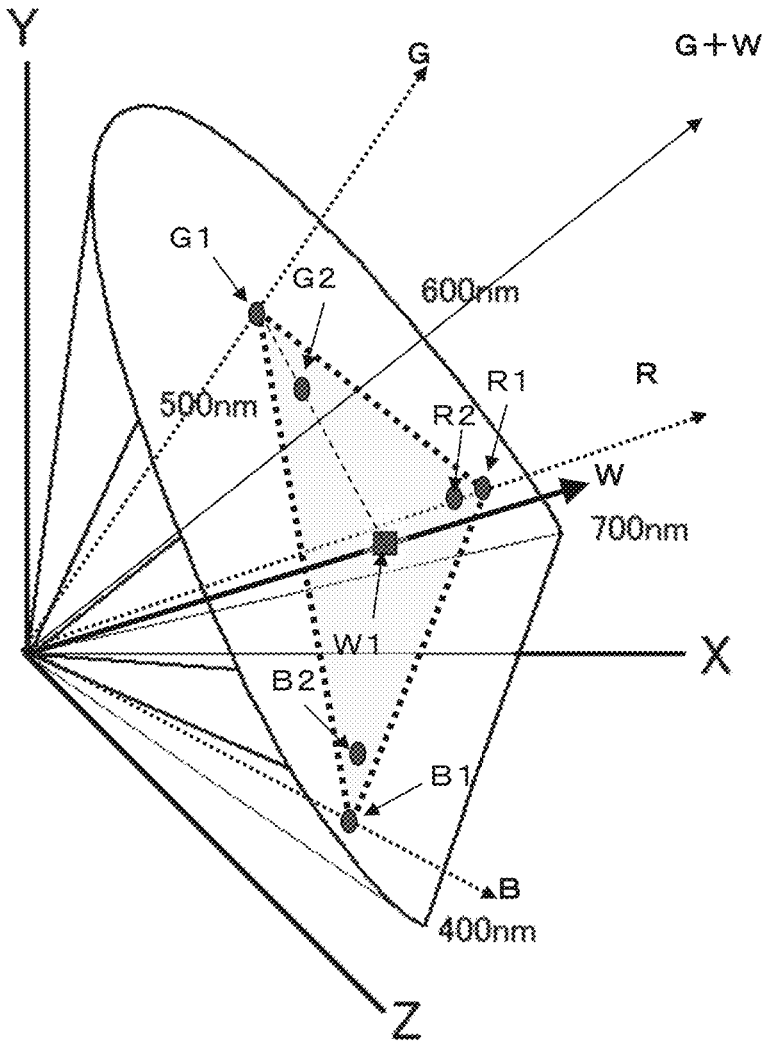
FIG. 12 is a diagram for describing colors necessary for describing First Embodiment of the present invention.

FIG. 12 is a diagram for describing colors and shows the chromaticity diagram three-dimensionally. The three primary colors are represented by vectors R, G, and B in a three-dimensional color space, and x and y components in a plane x+y+z=1 correspond to the chromaticity diagram in FIG. 10. X and y components at intersections R1, G1, and B1 of the vectors R, G, and B and the plane x+y+z=1 correspond to the chromaticity coordinates of the three primary colors (R, G, and B), respectively. In the display, for example including the white-color (W) single-color LED element 2*b* in addition to the three-in-one element 2*a* as shown in FIG. 5 and FIG. 7, a W vector is added to the vectors of R, G, and B, and the addition of the white color of the white-color LED element to the combined colors of the three primary colors increases the overall luminance.

In the display including the arranged three-in-one elements 2*a*, the proportion of the luminance of R, G, and B can be adjusted for each pixel 2. In general, the adjustment of the luminance proportion of R, G, and B is performed such that the combined color is white when all the three primary colors R, G, and B are emitted. In this case, the resultant vector W of the R, G, and B vectors passes through a white chromaticity point W1.

Referring to FIG. 13, color representation is described. FIG. 13A shows the same pixel arrangement as the pixel arrangement in FIG. 2C (the grid arrangement formed only of the three-in-one elements 2*a*), and FIG. 13C shows an example of single-color display in which only G is displayed in that arrangement. Similarly, FIG. 13B shows the same pixel arrangement as the pixel arrangement in FIG. 7 (the arrangement in which the white-color single-color LED 2*b* is placed diagonally in the basic grid 1 of the 2-by-2 matrix), and FIG. 13D shows an example in which only G is displayed in a single color in that arrangement. In FIGS. 13C and 13D, a reference sign 2*aa* shows a three-in-one element 2*aa* in which only G is lit. R and B are not lit in the three-in-one element 2*aa*. G is included in the three-in-one element 2*a* but not included in the white (W) single-color LED element 2*b*. Thus, in the single-color display of G, as compared with FIG. 13C in which G is lit in all the pixels, half of the pixels are the W pixels which are not lit and thus the number of element corresponding to the lit G is reduced by half in the arrangement in FIG. 13D. This means not only a reduced luminance in the single-color display of G but also a reduced resolution.

Returning to the explanatory diagram for colors in FIG. 12, the resultant vector of the single-color G and white (W) passes through a straight line connecting G1 and W1. While the passing point is shifted toward W1 as the luminance of white (W) is increased, G can be adjusted to a desired appropriate chromaticity value G2 by adjusting the luminance of W. In the chromaticity diagram in FIG. 11, G2 has a color purity lower than that of G1, but the area of the color reproduction range (triangle of a chain double-dashed line delimited by chromaticity points R2, G2, and B2) is equal to the area of the triangle of the dash-dotted line for HDTV, which means that the adjustment can be performed to ensure the range comparable to that for the Hi-Vision specifications. As a result, the white luminance for shifting G1 to G2 is added to the luminance value for obtaining G1, so that the luminance in the single-color display of G is improved.

Figure 13A:
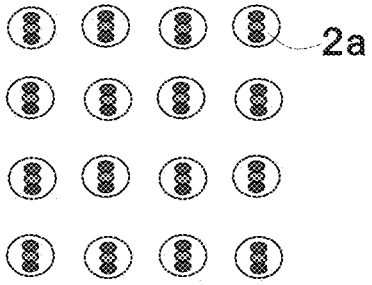
FIGS. 13A, 13B, 13C, and 13D are diagrams for describing a problem in color representation necessary for describing First Embodiment of the present invention.
Figure 13B:
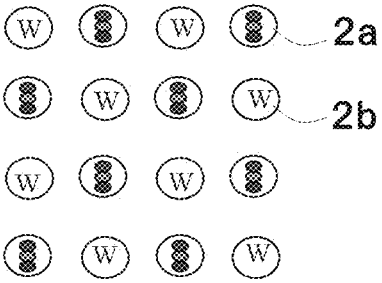
Figure 13C:
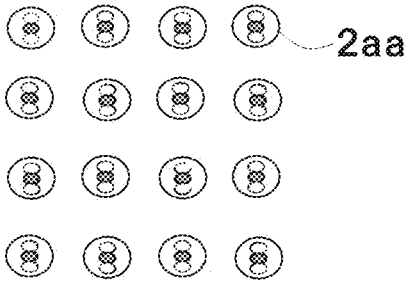
Figure 13D:
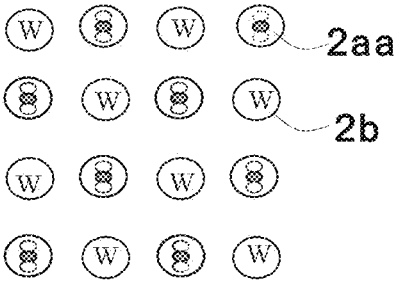

In FIG. 13B, since the white (W) single-color LED element 2*b* is lit as well as the single color G included in the three-in-one element 2*a*, the resolution is increased to improve reduced luminance and reduced resolution in single-color display which are the problems in replacing some of the three-in-one elements 2*a* with the inexpensive white (W) elements, resulting in improved representation of image outlines and fine lines.

Similarly, since the resultant vector of the single color B and white (W) is located on a straight line connecting B1 and W1, B can be adjusted to a desired appropriate chromaticity value B2 by adjusting the luminance of white (W). The single color R can also be adjusted to a desired appropriate chromaticity value R2 by adjusting the luminance of white (W). In any case, R2, G2, and B2 are obtained from the chromaticity points R1, G1, and B1 of the single color R, G, and B by adjusting the luminance of W. In the single-color display for R, G, and B, the addition of the luminance of W to the luminance of the three primary colors included in the three-in-one element 2*a* increases the luminance and the resolution.

Figure 14:
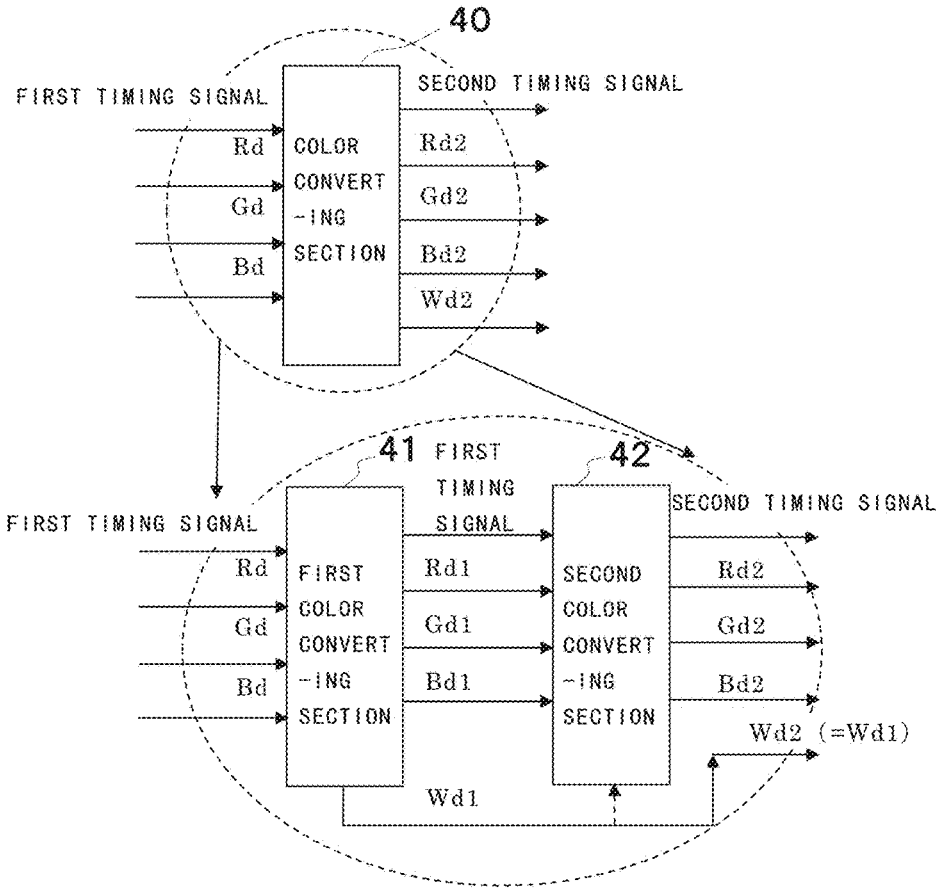
FIG. 14 is a diagram showing the configuration of a first color converting section in First Embodiment of the present invention.
Figure 15A:
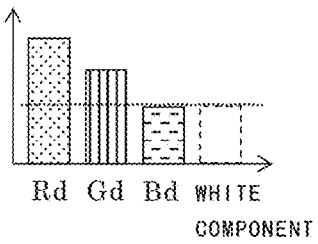
FIGS. 15A, 15B, and 15C are diagrams for describing color conversion in First Embodiment of the present invention.
Figure 15B:
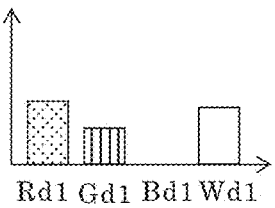
Figure 15C:
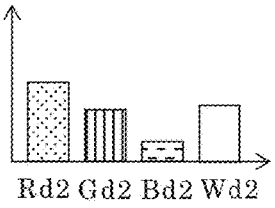

As shown in FIG. 14, the color converting section 40 may be formed of a first color converting section 41 and a second color converting section 42. FIG. 15 shows an example for describing the color converting section 40 in FIG. 9. Data input to the color converting section 40 is Rd, Gd, and Bd shown in FIG. 15A and does not contain any white (W) component. Based on the data, the first color converting section 41 extracts a white (W) component Wd1 from the color data Rd, Gd, and Bd for the three primary colors. The result of the extraction of the white component Wd1 from the original data Rd, Gd, and Bd for three primary colors is Rd1, Gdl, and Bd1 shown in FIG. 15B. The conversion from Rd, Gd, and Bd into Rd1, Gd1, and Bd1 is the subtraction of the white component (Wd1 component). Next, the second color converting section 42 performs color conversion computation for obtaining desired hues Rd2, Gd2, and Bd2 shown in FIG. 15C based on the data Rd1, Gd1, and Bd1.

The principles of the color conversion for obtaining Rd2, Gd2, and Bd2 from Rd1, Gd1, and Bd1 can be described in the following expression:

[Expression 1]

$$\begin{pmatrix} Rd2 \\ Gd2 \\ Bd2 \end{pmatrix} = \begin{pmatrix} a & b & c \\ d & e & f \\ g & h & i \end{pmatrix} \begin{pmatrix} Rd1 \\ Gd1 \\ Bd1 \end{pmatrix} \quad (1)$$

In the expression, a to j represent constants for color conversion. The constant are set to be variable to allow arbitrary setting, so that arbitrary display devices with different chromaticities can be controlled. In addition, the hue can be set in accordance with illumination in the environments and the like to provide the image display apparatus with high image quality.

In the chromaticity diagram in FIG. 10, the chromaticity points R2, G2, and B2 are located on straight lines (fine broken lines) connecting the chromaticity point W1 for W and the chromaticity points R1, G1, and B1 for the three primary colors R, G, and B in the LED. The positions of the chromaticity points R2, G2, and B2 on the chromaticity diagram may be adjusted to have a certain margin on the straight lines connecting to the chromaticity points R1, G1, and E1 for the three primary colors R, G, and B. Such color conversion involving the adjustment focused on W allows efficient conversion of chromaticity to effectively reduce consumed power. As shown in FIG. 11, although the chromaticity points R2, G2, and B2 are slightly displaced from the specifications for image signals with high quality such as for Hi-Vision, the area of the color reproduction range surrounded by the chain double-dashed line with the chromaticity points R2, G2, and B2 located at the apexes can be comparable to the area of the triangle for the Hi-Vision specifications surrounded by the dash-dotted line. Thus, display with low power consumption and high image quality can be achieved with a small influence in practical use such as a feeling of strangeness due to a different hue. Particularly, an efficient LED element such as an LED for illumination can be used for white (W) to reduce the power consumed by the display.

Second Embodiment

Figure 16:
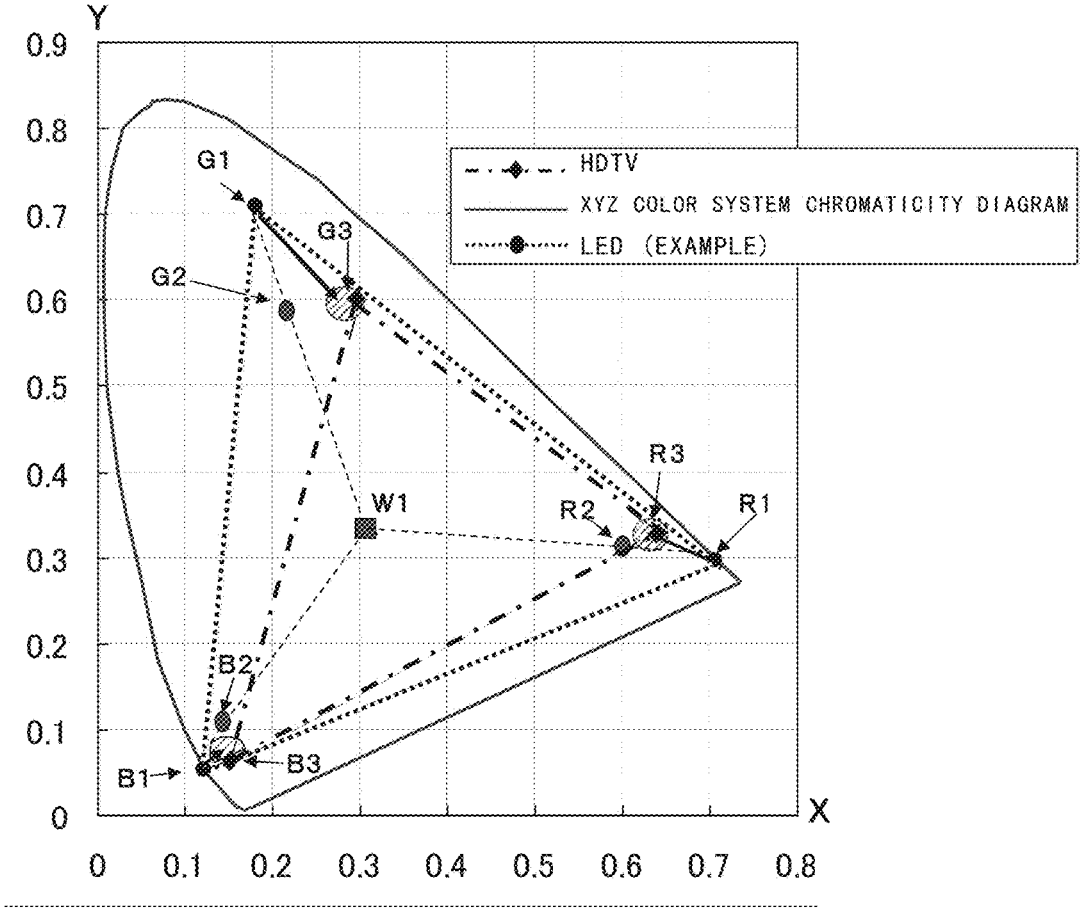
FIG. 16 is a diagram for describing a color reproduction range in Second Embodiment of the present invention.

Second Embodiment of the present invention is described with reference to a diagram for describing color reproduction ranges in FIG. 16. The color reproduction range in Second Embodiment is characterized in that the chromaticity points R2, G2, and B2 for the three primary colors described in First Embodiment are shifted to new chromaticity points R3, G3, and B3 by controlling the light-emission intensity of the LED for the three primary colors included in the three-in-one element 2*a* in addition to the light-emission intensity of white. The chromaticity points R3, G3, and B3 obtained in Second Embodiment correspond to points shifted from R2, G2, and B2 toward the apexes of a triangle representing the Hi-Vision specifications (HDTV) and are located within a circle indicated by hatch lines in FIG. 16. The shift of the chromaticity points R2, G2, and B2 to R3, G3, and B3 can be performed by changing the constants a to j for color conversion of the expression (1) in the second color converting section 42. The second color converting section 42 may refer to the extracted white component Wd1 as required.

As a result, the second color reproduction range can include not only the area on the chromaticity diagram but also the chromaticity points at substantially the same levels as those of the Hi-Vision specifications to achieve image display with high image quality. Human vision is less sensitive to color changes than to brightness/darkness characteristics. As long as the second color reproduction range generally satisfies chromaticity values for the three primary colors defined in the specifications for television signals, it is not essential that the chromaticity points exactly match the chromaticity points defined in the specifications in practical use.

As described above, First Embodiment and Second Embodiment have shown the use of the white-color LED in the example of replacing some of the three-in-one elements 2*a* arranged in the grid form with the inexpensive single-color light-emitting elements 2*b*. Various specifications are possible for the single-color light-emitting element 2*b*. To seek a significant cost reduction with a limited reduction in image quality, yellow-color or green-color (greenish yellow) LED elements or inexpensive elements for other colors can be used, not limited to the white-color LEDs. In this case, the first color converting section 41 extracts a common component from color data Rd, Gd, and Bd for three primary colors in accordance with the inexpensive color in use and obtains desired hues Rd2, Gd2, and Bd2 in cooperation with the second color converting section 42 in the subsequent stage. When the inexpensive color in use includes no component common to another color like green (G), the first color converting section 41 may be skipped to allow the second color converting section 42 to obtain the desired hues Rd2, Gd2, and Bd2. The color conversion processing in this case may be performed such that the chromaticity points R2, G2, and B2 may be corrected to have wide adjustment ranges as indicated by hatched ovals in FIG. 10 as long as the correction is uniform with small variations. The chromaticity points R3, G3, and B3 may be corrected at the equivalent level to that for R3, G3, and B3 in FIG. 16 since the three primary colors included in the three-in-one element 2*a* can be used for the correction.

Third Embodiment

In the three-in-one element 2*a* described in First Embodiment and Second Embodiment, the LED chips for the three primary colors of R, G, and B are included in a single LED package. The three-in-one element 2*a* is provided by using a material with a high transmittance for the surface of the package and a material with a high reflectance for the inner face in order to enhance the light-emission efficiency of the LED. As a result, the three-in-one element 2*a* appears to be whitish when viewed from the display face, which contributes to a reduced contrast. Third Embodiment of the present invention provides the image display apparatus 10 including a filter on the face of the light-emitting element for suppressing the transmission of light other than emitted light color in order to limit the reduced contrast.

Figure 17:
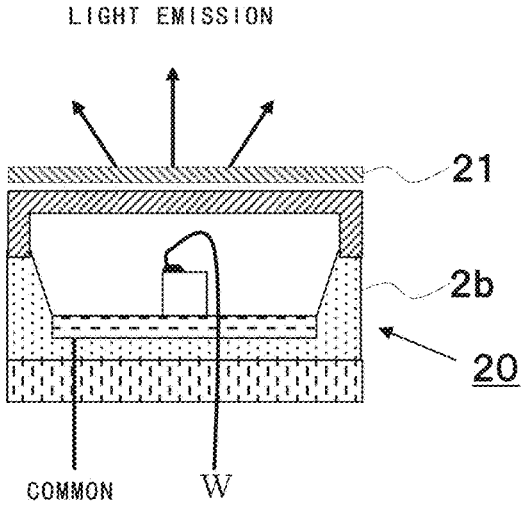
FIG. 17 is a sectional side view of a single-color LED element according to Third Embodiment of the present invention.

FIG. 17 is a sectional side view of a single-color LED element 20 provided with such a filter. The image display apparatus 10 according to Third Embodiment includes the basic grid of four pixels of a 2 by 2 matrix according to First Embodiment or Second Embodiment, in which some of the three-in-one elements 2*a* including three primary colors of R, G, and B arranged in a grid pattern are replaced with single-color light-emitting elements. FIG. 17 shows a single-color LED element 2*b* serving as such a single-color light-emitting element. A gray-color filter 21 is formed as a color filter for emitted light color on the front face (light-emitting face) of the white-color single-color LED element 2*b*. For the three-in-one element 2*a*, it is difficult to form the filter efficiently passing three primary colors at different wavelengths, and when the filter is formed on the front face, the luminance tends to be reduced. For the single-color light-emitting element, however, the filter 21 passing the emitted light color of the LED can be formed on the light-emitting face to suppress the transmission of light other than the emitted light color, thereby limiting a reduction in luminance and suppressing reflection of external light from an area with a high reflectance on the package face or inside the package.

Figure 18A:
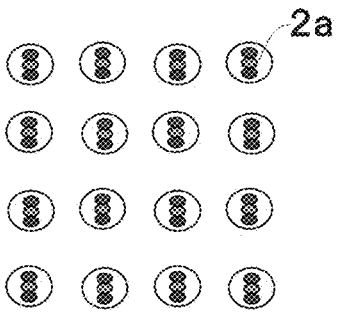
FIGS. 18A, 18B, and 18C are diagram showing an exemplary pixel arrangement in Third Embodiment of the present invention.
Figure 18B:
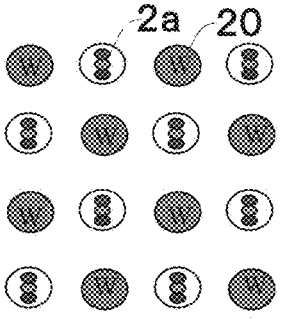
Figure 18C:
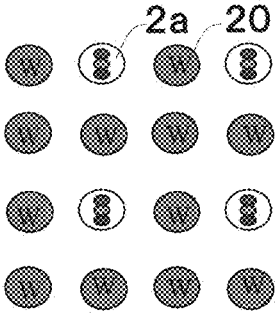

FIG. 18 is a diagram showing an exemplary pixel arrangement for describing how a display screen appears in the image display apparatus 10 to which Third Embodiment is applied. FIG. 18A shows an exemplary pixel arrangement in which only the three-in-one element 2*a* is used. FIG. 18B shows an exemplary pixel arrangement in which half of the pixels in FIG. 18A are replaced with single-color LED elements 20 having the gray-color filter 21 and the single-color LED elements 20 alternate with the three-in-one elements 2*a*. FIG. 18C shows an exemplary pixel arrangement in which the three-in-one element 2*a* is used for one pixel 2 in the basic grid 1 of the 2 by 2 matrix and the single-color LED element 20 having the gray-color filter 21 is used for the remaining three pixels 2.

The filter 21 can be formed with various methods such as a film affixing method and an ink applying or printing method. The transmittance of light through the filter 21 formed on the front face of the white-color single-color LED element 2*b* can be arbitrarily adjusted, for example.

As compared with the arrangement of the three-in-one elements 2*a* in a grid pattern shown in FIG. 18A, in the image display apparatus 10 in which some of the elements are replaced with the single-color LED elements 20 having the gray-color filter as shown in FIG. 18B, reflection of light (external light) is limited from the outside of the image display apparatus 10 when it is not lit, and thus the screen appears to be blackish. The color reproduction range in this case is represented as the triangle delimited by R1, G1, and B1 shown in FIG. 12. When external light is applied to the screen in bright environments, the chromaticity points for three primary colors are shifted inward of the triangle under the influence of color vectors of the reflected light, and the color reproduction range tends to be narrowed. When the color filter for the single-color light-emitting element is formed on the light-emitting face to reduce the reflection on the surface, the color reproduction range is maintained to allow the reproduction of clear colors with high fidelity to the color conversion technology.

Although the above example shows the white-color light-emitting element used for the single-color LED element 2*b*, a yellow-color or green-color (greenish yellow) LED element can also be used. In addition, an inexpensive single-color LED element can be used other than white, yellow, and green (greenish yellow) LED elements. Since the luminosity factor of humans is high for colors from greenish yellow to green, display with a high resolution is expected. When some of the whitish three-in-one elements 2*a* are replaced with the inexpensive LED elements having the color filter formed on the light-emitting face, the pixel structure may be recognized as a distinct noise when the screen is viewed at an extremely short distance, but this type of noise can be avoided when the screen is viewed at a proper distance. As a result, the inexpensive image display apparatus 10 with high image quality can be provided even when the inexpensive yellow or green light-emitting element is used.

Figure 19A:
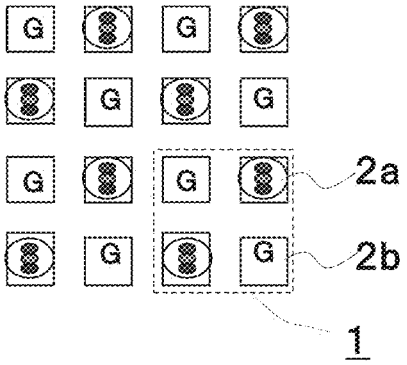
FIGS. 19A and 19B are diagram showing an exemplary pixel arrangement in Third Embodiment of the present invention.
Figure 19B:
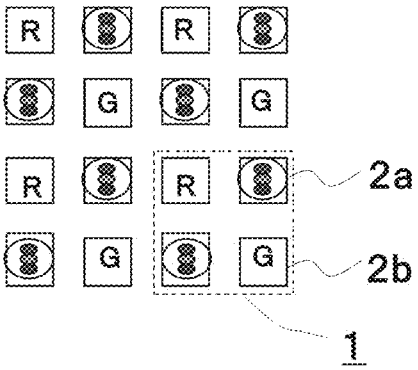
Figure 20A:
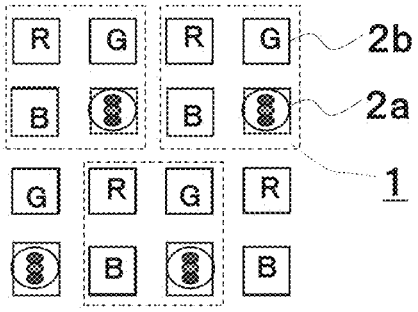
FIGS. 20A and 20B are diagram showing an exemplary pixel arrangement in Third Embodiment of the present invention.
Figure 20B:
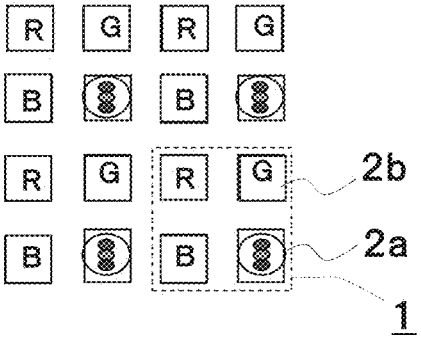

The embodiments of the present invention can be combined freely, or modified or omitted as appropriate within the spirit or scope of the present invention. For example, when the three-in-one element 2*a* is placed diagonally in the basic grid 1 as shown in FIG. 19, a green-color LED element (G) may be placed as the single-color LED element 2*b* as shown in FIG. 19A, or two types including a green-color LED element (G) and a red-color LED element (R) may be placed in combination in a grid pattern as shown in FIG. 19B. When the three-in-one element 2*a* is placed as one element of the basic grid 1 as shown in FIG. 20, three types including green-color, red-color, and blue-color LED elements (G, R, and B) can be used in combination as the single-color LED element 2*b*. FIG. 20A shows an example in which the basic grids 1 are staggered, and FIG. 20B shows an example in which the basic grids 1 are placed vertically and horizontally in a matrix pattern. As shown in FIG. 19B, the single-color LED elements 2 of different colors may be arranged alternately in a staggered form. When two or more types of single-color LED elements 2*b* are used, the color reproduction range correcting means adjusts the light-emission intensity for each color of the single-color LED elements 2*b* or for all the colors together. Although the above embodiments have been described in conjunction with the LED element used for the light-emitting element, another light-emitting element may be used. Although the pixel 2 is indicated by the circle or the square in Figures, this is for illustrative and does not limit the shape of the light-emitting element.

The invention claimed is:

1. An image display apparatus comprising:

a display section provided by pixels arranged in a grid pattern, each of the pixels being formed of a light-emitting element, wherein basic grids (square grids) are repeatedly arranged in a grid pattern, each of the basic grids consisting of four pixels of a 2 by 2 matrix, each of the basic grids having a pattern in which one or two pixels of the four pixels being assigned a three-in-one element including three primary colors of R, G, and B and the remaining pixels being assigned a white-color light-emitting element, and a processor configured to correct a first color reproduction range provided by chromaticities of the three primary colors of R, G, and B to a second color reproduction range by controlling a light emission intensity of the white-color light-emitting element, wherein the processor is configured to calculate color data Rd1, Gd1, and Bd1 by subtracting a white component Wd1 from color data Rd, Gd, and Bd for three primary colors, which are input based on the first color reproduction range, convert the color data Rd1, Gd1, and Bd1 into color data Rd2, Gd2, and Bd2 in accordance with the second color reproduction range, and adjust the light-emission intensity of the three-in-one element based on the color data Rd2, Gd2, and Bd2, and adjust the light-emission intensity of the white-color light-emitting element based on a value Wd2 obtained based on the white component Wd1.

2. The image display apparatus according to claim 1, wherein:

the white-color light-emitting element is an LED element.

3. The image display apparatus according to claim 1, wherein: chromaticities of Rd2, Gd2, and Bd2 in the second color reproduction range are set to be located on or close to a line connecting points of the chromaticities of the three primary colors of Rd1, Gd1, and Bd1 and a point of a chromaticity of a setting value of a white color on a chromaticity diagram.

4. The image display apparatus according to claim 1, wherein:

the second color reproduction range is a color reproduction range adjusted to be close to chromaticity values of three primary colors defined in specifications for television signals.

5. The image display apparatus according to claim 1, wherein:

the three-in-one element is assigned to two pixels located diagonally of the four pixels of the basic grid and the white-color light-emitting element is assigned to the remaining two pixels.

6. The image display apparatus according to claim 1, wherein:

a gray-color filter is provided only on the front face of the white-color light emitting element.

7. The image display apparatus according to claim 1, wherein the processor shifts the chromaticities of the three primary colors by controlling the light-emission intensity for the three primary colors included in the three-in-one element.

* * * * *